US011692676B2

(12) United States Patent
Gielen et al.

(10) Patent No.: US 11,692,676 B2
(45) Date of Patent: Jul. 4, 2023

(54) LIGHTING DEVICE BASED ON SOLID-STATE LIGHTING TECHNOLOGY

(71) Applicant: SIGNIFY HOLDING B.V., Eindhoven (NL)

(72) Inventors: Vincent Stefan David Gielen, Gastel (NL); Johannes Petrus Maria Ansems, Hulsel (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/629,695

(22) PCT Filed: Jul. 16, 2020

(86) PCT No.: PCT/EP2020/070199

§ 371 (c)(1),
(2) Date: Jan. 24, 2022

(87) PCT Pub. No.: WO2021/018623

PCT Pub. Date: Feb. 4, 2021

(65) Prior Publication Data

US 2022/0252226 A1 Aug. 11, 2022

(30) Foreign Application Priority Data

Jul. 26, 2019 (EP) ..... 19188533

(51) Int. Cl.

| | |
|---|---|
| ***F21K 9/232*** | (2016.01) |
| ***F21K 9/66*** | (2016.01) |
| ***F21V 3/04*** | (2018.01) |

(52) U.S. Cl.

CPC ..... *F21K 9/232* (2016.08); *F21K 9/66* (2016.08); *F21V 3/049* (2013.01)

(58) Field of Classification Search

CPC ... F21K 9/232; F21K 9/60; F21K 9/66; F21V 3/049

See application file for complete search history.

(56) References Cited

U.S. PATENT DOCUMENTS

| | | | | |
|---|---|---|---|---|
| 9,046,238 | B2 | 6/2015 | Lin et al. | |
| 2014/0016324 | A1 | 1/2014 | Hsin | |
| 2014/0268802 | A1 | 9/2014 | Sun et al. | |
| 2017/0299145 | A1* | 10/2017 | Dong | F21K 9/68 |
| 2018/0246305 | A1 | 8/2018 | Mssenberg et al. | |

FOREIGN PATENT DOCUMENTS

| | | | |
|---|---|---|---|
| CN | 103062703 | A | 4/2013 |
| DE | 202015106206 | U1 | 2/2017 |
| JP | 2010062005 | A | 3/2010 |
| WO | 2011125009 | A1 | 10/2011 |

* cited by examiner

*Primary Examiner* — Karabi Guharay

(57) ABSTRACT

A lighting device (1) comprising: a substrate defining a plane; at least one solid-state light source mounted on the substrate, an outer light-transmissive envelope (2), and a light-transmissive wall which is arranged at a circumference of the substrate and which has an extension along and is curved towards an optical axis (A) of the lighting device (1). The light-transmissive wall comprises an edge portion distal to the substrate, which edge portion is adapted to diffuse light from the at least one solid-state light source such that a shadow on the outer light-transmissive envelope (2) is blurred, the shadow being caused by an electrical component mounted on the substrate and blocking light emitted by the at least one solid-state light source.

11 Claims, 3 Drawing Sheets

LIGHTING DEVICE BASED ON SOLID-STATE LIGHTING TECHNOLOGY

CROSS-REFERENCE TO PRIOR APPLICATIONS

This application is the U.S. National Phase application under 35 U.S.C. § 371 of International Application No. PCT/EP2020/070199, filed on Jul. 16, 2020, which claims the benefit of European Patent Application No. 19188533.4, filed on Jul. 26, 2019. These applications are hereby incorporated by reference herein.

FIELD OF THE INVENTION

The present invention relates to a lighting device based on solid-state lighting technology.

BACKGROUND OF THE INVENTION

There exist lighting devices, such as certain types of retrofit light bulbs, which have light-emitting diodes and other electrical components mounted very closely together on circuit board. A drawback of this compact design is that large components, like for example inductors, may cause highly visible shadows on an outer bulb of the lighting device. Some conventional lighting devices include a reflector for increased luminescence efficiency and an inner bulb with light scattering properties for color mixing, which reduce this problem to some extent. Many lighting devices, however, do not have such components, and there is therefore a perceived need to develop new solutions for reducing the above-noted problem of unwanted shadows on the outer bulb.

SUMMARY OF THE INVENTION

In view of the above, and according to a first aspect of the present invention, there is presented a lighting device comprising: a substrate defining a plane; at least one solid-state light source mounted on the substrate, wherein the at least one solid-state light source is arranged to emit light along an optical axis substantially perpendicular to the plane; an outer light-transmissive envelope arranged to receive light emitted by the at least one solid-state light source; and a light-transmissive wall arranged at a circumference of the substrate and having an extension along the optical axis, wherein the wall is curved towards the optical axis and comprises an edge portion distal to the substrate, wherein the edge portion is adapted to diffuse light from the at least one solid-state light source such that a shadow on the envelope is blurred, and wherein the shadow is caused by an electrical component which is mounted on the substrate and blocks light emitted by the at least one solid-state light source.

According to a second aspect to the present invention, there is presented a luminaire comprising the lighting device.

By the expression "optical axis" is here meant a geometrical axis around which the distribution of the light emitted by the lighting device is approximately rotationally symmetric. By the optical axis being "substantially" perpendicular to the plane defined by the substrate is meant that the optical axis is perpendicular to or nearly perpendicular to the plane. Thus, thus the expression "substantially perpendicular" is not meant to exclude small deviations from perpendicularity, for example due to manufacturing tolerances. By the light-transmissive wall being arranged "at" the circumference of the substrate is arranged close to the circumference or on the circumference.

It is noted that lighting devices which include various light-diffusing components are known in the art, e.g. from U.S. Pat. No. 9,046,238. However, conventional solutions for diffusing light are often considered not to adequately address the problem of unwanted shadows on the outer envelope, or to be too complicated or expensive. The present invention is based on the realization that using a wall which is arranged at the circumference of the light source substrate, curved toward the optical axis and has an edge portion adapted to diffuse light may help to reduce unwanted shadow effects on the outer envelope and may also help to reduce unwanted intensity over angle effects. The wall may diffuse light both in the plane of the substrate and perpendicularly to the substrate. The edge portion may help to increase the efficiency with which light flux density is blurred, in particular in the direction perpendicular to the plane of the substrate.

There are different ways of adapting the edge portion to diffuse light so as to help reduce shadows projected on the outer envelope. For example, the edge portion may comprise a serration. The edge portion may for example comprise a saw-tooth serration and/or a wavy serration. A sinusoidal serration is an example of a wavy serration. Alternatively, or additionally, the edge portion may have a varying thickness. The thickness of the edge portion may for example decrease toward a tip of the edge portion.

The wall may extend around the entire circumference of the substrate. Arranging the wall around the entire circumference may help to particularly effectively blur unwanted shadows. However, it is conceivable that the light sources and any other electrical components on the substrate are be positioned such that the wall does not need to extend around the entire circumference in order to blur unwanted shadows on the envelope.

The wall may for example be circular. A circular wall may diffuse light in a particularly homogenous manner, which may be desirable in some applications.

The electrical component may be different from the at least one solid-state light source. Thus, the electrical component may be a component which is not a light source. It is, however, noted that in some applications a shadow may be formed on the outer envelope due to a light source blocking light from another light source.

The lighting device may further comprise a connector for electrically and mechanically connecting the lighting device to a socket. The connector may be electrically connected to the at least one solid-state light source. The lighting device may be a retrofit light bulb. Such a retrofit light bulb typically comprises the just-mentioned connector.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
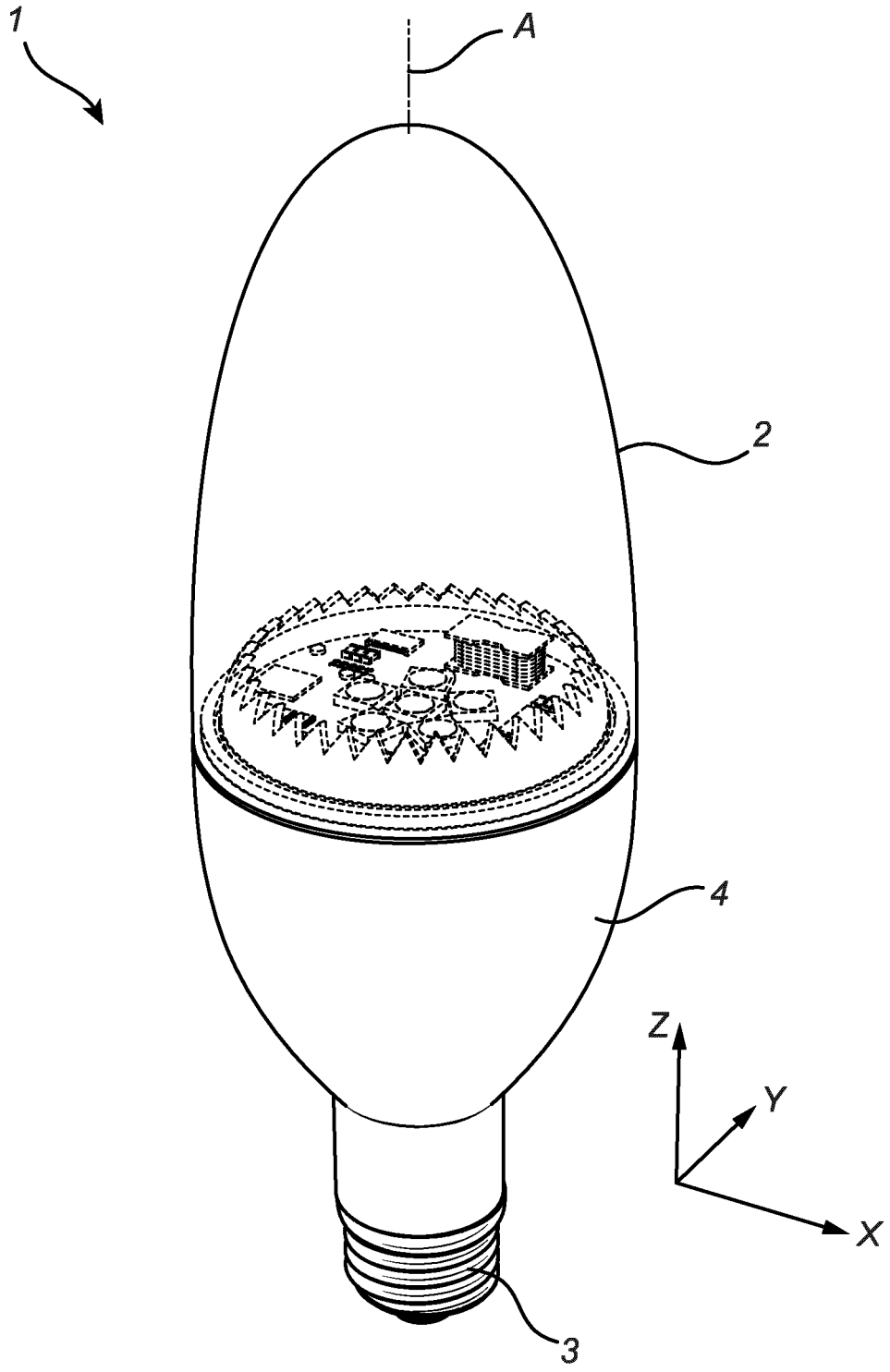
FIG. 1 is a schematic perspective view of a lighting device according to an embodiment of the present invention.

FIG. 1 shows a lighting device 1 which may be referred to as a retrofit light bulb or a candle light bulb. The lighting device 1 may be included in various types of luminaires, such as wall-mounted luminaires, ceiling-mounted luminaires, table lamps, chandeliers, candelabras, etc. Similar to a conventional light bulb, the lighting device 1 comprises an outer light-transmissive envelope 2, which may for example be made of glass or a plastic material, and a connector 3. The connector 3 is configured to mechanically and electrically connect the lighting device 1 to a conventional lightbulb socket (not shown). In the illustrated example, the connector 3 is a threaded Edison connector, such as E14, E26 or E27. Other types of connectors 3 can be used as well, like e.g. bayonet etc. An optional intermediate part 4 is arranged between the envelope 2 and the connector 3. In this case, the intermediate part 4 is made of a plastic material and has a varying, substantially circular cross section. The connector 3, the intermediate part 4 and the envelope 2 are arranged along the optical axis A of the lighting device 1, the distribution of the light emitted by the lighting device 1 being substantially rotationally symmetric with respect to the optical axis A. The optical axis A coincides in this case with a central, longitudinal axis of the lighting device 1. In FIG. 1, the lighting device 1 is oriented such that the optical axis A is parallel to the z axis.

Figure 2:
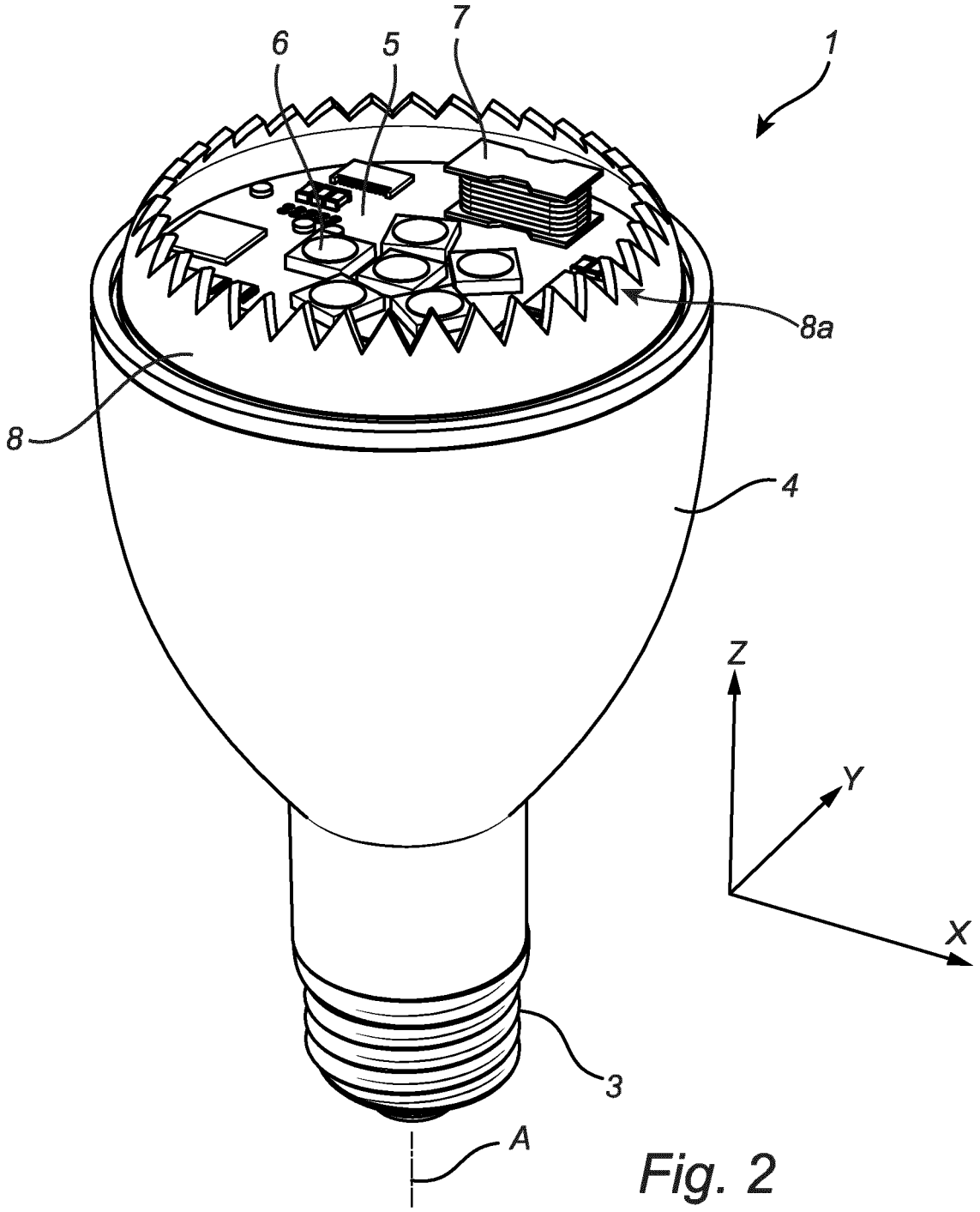
FIG. 2 is a schematic perspective view of the lighting device in FIG. 1 with a part removed to reveal some of the inner components of the lighting device.

FIG. 2 shows a part of the lighting device 1 in FIG. 1 without the envelope 2 to more clearly illustrate some of the inner components of lighting device 1. As can be seen in FIG. 2, the lighting device 1 comprises a substrate 5. The substrate 5 is in this case a circuit board, such as a printed circuit board or a metal-core printed circuit board, which is electrically connected to the connector 3. The position of the substrate 5 is here near the interface between the envelope 2 (see FIG. 1) and the intermediate part 4. The substrate 5 is in this case substantially circular and centered on the optical axis A. Further, the substrate 5 is here planar and defines a plane, which in this case is a plane which contains the substrate 5. Thus, the substrate 5 and the plane defined by the substrate 5 are in this case parallel. In FIG. 2, the lighting device 1 is oriented such that the plane is parallel to the xy plane and, thus, perpendicular to the optical axis A. It should be noted that the plane defined by the substrate 5 and the optical axis A may in a differently example be substantially, or approximately, perpendicular instead of perpendicular as in the example illustrated in FIGS. 1 and 2.

Several solid-state light sources 6 are mounted on the substrate 5 and electrically connected thereto. Thus, the substrate 5 mechanically supports and secures the light sources 6, and also carries conducting paths (not shown) for electrical connection of the light sources 6. The light sources 6 are in this case mounted at a central part of the substrate 5 and oriented to emit light away from the substrate 5, towards the envelope 2. In the illustrated example, there are six light sources, although any other number of light sources 6 may be included in the lighting device 1 in a different example. The lighting device 1 may include only one light source 6, for example. The light sources 6 are in this example light-emitting diodes (LEDs), such as semiconductor LEDs, organic LEDs or polymer LEDs. All of the light sources 6 may be configured to emit light of the same color, such as white light, or different light sources 6 may be configured to emit light of different colors.

As is most clearly seen in FIG. 2, the substrate 5 has, in addition to the light sources 6, several other electrical components mounted thereon and electrically connected thereto. The electrical components here include an inductor, which is indicated by the reference numeral 7. Other electrical components which may be mounted on the substrate 5 are for example a driver serving to convert AC power from a mains power supply to appropriate DC power for the light sources 6. The substrate 5, the light sources 6 and the other electrical components, such as the inductor 7, may in this case together be referred to as an L2.

The lighting device 1 further comprises a wall 8, which in this case may alternatively be referred to as a ring. The wall 8 is here arranged on the substrate 5, close to the circumference of the latter and surrounds, in the plane of the substrate 5, the light sources 6 and the electrical components 7. The wall 8 here also surrounds the optical axis A. It is noted that, in a different example, the wall 8 does not necessarily have to be arranged on the substrate 5, but can for example be arranged outside the circumference of the substrate 5. The wall 8 is here circular. The wall 8 extends along the optical axis A and is curved towards the optical axis A, i.e. the wall 8 is curved radially inward. The height of the wall 8, as measured along the z axis in FIG. 2, varies between applications but may for example be in the range from about 4 mm to about 7 mm. The ring 8 is made of a light-transmissive material, such as a plastic material.

The wall 8 has an edge portion 8*a* which is distal to the substrate 5. The edge portion 8*a* here refers a circular portion or region of the wall 8 close to the upper tip of the wall 8 in FIG. 2. In the illustrated case, the edge portion 8*a* comprises a serration, specifically a saw-tooth serration. Thus, the serration of the edge portion 8*a* has a pointed shape at its tips and/or its notches. The suitable number of "teeth" depends on various application-specific factors, such as the size of the wall 8, but may for example be approximately 50 or greater. In some applications, the outer diameter of the wall 8 may for example be in the range from about 30 mm to about 35 mm. The inner diameter of the wall 8 may for example be from about 3 mm smaller than the outer diameter to about 7 mm smaller than the outer diameter.

The wall 8 is adapted to blur shadows and light intensity variations that may form on the envelope 2 (see FIG. 1) due to one or more of the electrical components mounted on the substrate 5, such shadows and intensity variations typically being caused by relatively large components, such as the inductor 7. It may be noted that shadows and intensity variations on the envelope 2 may some cases be due to a light source blocking light emitted by another light source. The wall 8 helps to blur such shadows and intensity variations too.

Specifically, the wall 8 is adapted to blur the light flux density in both the plane defined by the substrate 5, i.e. the xy plane in FIGS. 1 and 2, and parallel to the optical axis A, i.e. the z axis in FIGS. 1 and 2. The non-serrated portion of the wall 8 here mainly blurs the light flux density in the xy plane, and the edge portion 8*a* here helps to blur the light flux density mainly in the z direction. Hence, the wall 8 helps to create a graded light flux intensity on the envelope 2. The serration of the edge portion 8*a* is here designed for optimal overlap of the light passing therethrough from different light sources 6.

During operation, the lighting device 1 receives in this case power from the mains via the connector 3 which is connected to a lightbulb socket. The light sources 6 emit light which is transmitted through the envelope 2 to illuminate the surroundings of the lighting device 1. The wall 8 helps to blur unwanted shadow effects on the envelope 2, caused by the inductor 7 and other electrical components on the substrate 5, which block light from the light sources 6.

Figure 3:
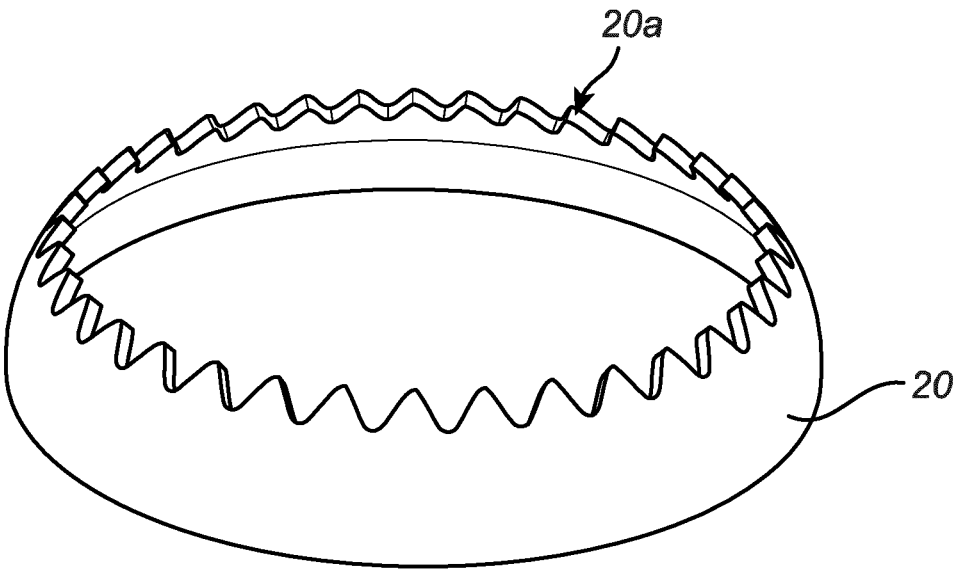
FIG. 3 is a schematic perspective view of a wall with an edge portion adapted to diffuse light.

FIG. 3 shows another example of a wall 20. The wall 20 is similar to the wall 8 shown in FIGS. 1 and 2, except in that the edge portion 20*a* of the wall 20 comprises a sinusoidal serration. Thus, the serration of the edge portion 20*a* has a curved shape at its tips and/or its notches. It is noted that the wall 8 may be provided with a different type of wavy serration than a sinusoidal serration in a different example.

Figure 4:
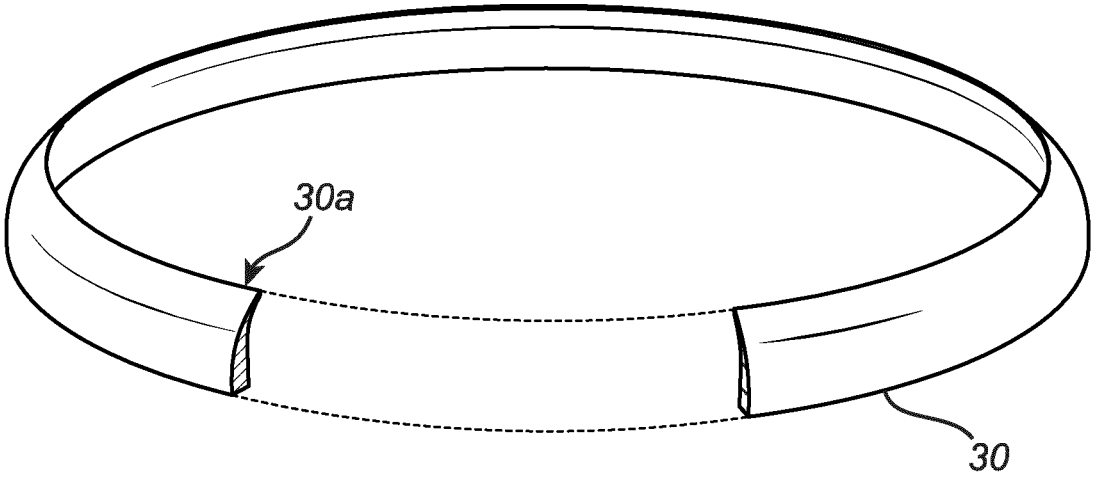
FIG. 4 is a schematic perspective view of another wall with a part cut away.

FIG. 4 shows yet another example of a wall 30. The wall 30 is similar to the walls 8, 20 shown in FIGS. 1 to 3, except in that the wall 30 has a non-serrated edge portion 30*a*. Instead, the edge portion 30*a* has a varying thickness. Specifically, the edge portion 30*a* here gets gradually thinner towards the upper tip of the wall 8. It should be noted that the wall 30 shown in FIG. 4 may be combined with the walls 8, 20 shown in FIGS. 1 to 3. For example, in some applications the lighting device may have a wall with an edge portion that is both serrated and has a varying thickness.

The person skilled in the art realizes that the present invention by no means is limited to the preferred embodiments described above. On the contrary, many modifications and variations are possible within the scope of the appended claims. For example, different parts of the wall's edge portion may be serrated in different ways. The edge portion of the wall may comprise a sinusoidal serration and a saw-tooth serration, for instance. Also, some parts of the wall's edge portion may be serrated and others non-serrated. Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A lighting device comprising:

a substrate defining a plane;

at least one solid-state light source mounted on the substrate, wherein the at least one solid-state light source is arranged to emit light along an optical axis substantially perpendicular to the plane;

an outer light-transmissive envelope arranged to receive light emitted by the at least one solid-state light source; and a light-transmissive wall arranged at a circumference of the substrate and having an extension along the optical axis, wherein the light-transmissive wall is curved towards the optical axis and comprises an edge portion distal to the substrate, wherein the edge portion is adapted to diffuse light from the at least one solid-state light source such that a shadow on the outer light-transmissive envelope is blurred, and wherein the shadow is caused by an electrical component which is mounted on the substrate and blocks light emitted by the at least one solid-state light source, and, wherein the edge portion comprises a serration.

2. The lighting device according to claim 1, wherein the edge portion comprises a saw-tooth serration.

3. The lighting device according to claim 1, wherein the edge portion comprises a wavy serration, for example a sinusoidal serration.

4. The lighting device according to claim 1, wherein the edge portion has a varying thickness.

5. The lighting device according to claim 4, wherein the thickness of the edge portion decreases toward a tip of the edge portion.

6. The lighting device according to claim 1, wherein the light-transmissive wall extends around the entire circumference of the substrate.

7. The lighting device according to claim 1, wherein the light-transmissive wall is circular.

8. The lighting device according to claim 1, wherein the electrical component is different from the at least one solid-state light source.

9. The lighting device according to claim 1, further comprising a connector for electrically and mechanically connecting the lighting device to a socket, wherein the connector is electrically connected to the at least one solid-state light source.

10. The lighting device according to claim 1, wherein the lighting device is a retrofit light bulb.

11. A luminaire comprising the lighting device according to claim 1.

* * * * *